US010420980B2

(12) United States Patent
Wu

(10) Patent No.: US 10,420,980 B2
(45) Date of Patent: Sep. 24, 2019

(54) TWO-IN-ONE TRAINING DEVICE

(71) Applicant: Strength Master Fitness Tech. Co., Ltd., Changhua County (TW)

(72) Inventor: Shu-Yao Wu, Changhua County (TW)

(73) Assignee: Strength Master Fitness Tech. Co., Ltd., Puxin Township (TW)

( * ) Notice: Subject to any disclaimer, the term of this patent is extended or adjusted under 35 U.S.C. 154(b) by 0 days.

(21) Appl. No.: 15/423,976

(22) Filed: Feb. 3, 2017

(65) Prior Publication Data

US 2018/0221706 A1 Aug. 9, 2018

(51) Int. Cl.

| | |
|---|---|
| ***A63B 24/00*** | (2006.01) |
| ***A63B 22/00*** | (2006.01) |
| ***A63B 71/06*** | (2006.01) |
| ***A63B 23/12*** | (2006.01) |

(Continued)

(52) U.S. Cl.

CPC ..... *A63B 22/0046* (2013.01); *A63B 21/4043* (2015.10); *A63B 22/0076* (2013.01); *A63B 22/0087* (2013.01); *A63B 23/03525* (2013.01); *A63B 23/12* (2013.01); *A63B 24/0087* (2013.01); *A63B 71/0619* (2013.01); *A63B 21/4035* (2015.10); *A63B 2022/0035* (2013.01); *A63B 2022/0079* (2013.01); *A63B 2024/0093* (2013.01); *A63B 2071/0658* (2013.01); *A63B 2220/24* (2013.01); *A63B 2220/34* (2013.01);

(Continued)

(58) Field of Classification Search

CPC ..... A63B 22/0046; A63B 22/0076; A63B 21/154; A63B 21/4035; A63B 21/4034; A63B 71/0619; A63B 23/12; A63B 2022/0079; A63B 2071/0658; A63B 22/0087; A63B 21/4043; A63B 23/03525; A63B 24/0087; A63B 2220/805; A63B 2220/44; A63B 2220/34; A63B 2220/24; A63B 2024/0093; A63B 2022/0035; A63B 22/0079; A63B 22/0082; A63B 22/0084

See application file for complete search history.

(56) References Cited

U.S. PATENT DOCUMENTS 6,991,589 B1 * 1/2006 Patterson ..... A63B 21/0088 482/142
7,179,205 B2 * 2/2007 Schmidt ..... A63B 21/0058 482/51

(Continued)

*Primary Examiner* — Andrew S Lo
(74) *Attorney, Agent, or Firm* — Wang Law Firm, Inc.

(57) ABSTRACT

The present disclosure illustrates a two-in-one training device including a support structure, a resistance output module, a cable rolling device, a rear pulley, a cable, a handle assembly and an operating module. The support structure includes a front support member, a connection frame and a rear support member. The resistance output module is disposed on an end of the support structure. The resistance output module includes a resistance device, a controlling device and an encoder. The controlling device receives a detection signal and setting signal and transmits a control signal. The encoder detects an operational state of the resistance device and output a detection signal. The cable rolling device is connected to the torque enhancing device. The cable has an end wound on the cable rolling device, and other end connected with the handle assembly. The operating module is electrically connected to the resistance output module.

10 Claims, 8 Drawing Sheets

(51) Int. Cl.
*A63B 23/035* (2006.01)
*A63B 21/00* (2006.01)

(52) U.S. Cl.
CPC ..... *A63B 2220/44* (2013.01); *A63B 2220/805* (2013.01)

(56) References Cited

U.S. PATENT DOCUMENTS

| | | | | |
|---|---|---|---|---|
| 8,235,874 | B2 * | 8/2012 | D'Eredita | A63B 21/154 482/114 |
| 9,770,622 | B2 * | 9/2017 | Campanaro | A63B 22/0087 |
| 2005/0272568 | A1 * | 12/2005 | Wang | A63B 22/0076 482/72 |
| 2006/0009334 | A1 * | 1/2006 | Smith | A63B 22/0023 482/72 |
| 2014/0194260 | A1 * | 7/2014 | Campanaro | A63B 21/068 482/131 |
| 2016/0059061 | A1 * | 3/2016 | Lagree | A63B 21/00065 482/92 |
| 2016/0144223 | A1 * | 5/2016 | Dalebout | A63B 22/0076 482/72 |

* cited by examiner

TWO-IN-ONE TRAINING DEVICE

BACKGROUND OF THE INVENTION

1. Field of the Invention

The present disclosure relates to a two-in-one training device. More particularly, the present disclosure relates to a training device providing training for rowing boats and skiing.

2. Description of the Related Art

A conventional exercise machine only provides a user to perform a pulling action in a horizontal direction or in a longitudinal direction to simulate the action of rowing boats and skiing, so it is hard for the user to train all active muscles of sitting and standing. Thus, the conventional exercise machine cannot provide the complete training of different muscles. Therefore, what is need is to develop a training device capable of providing the user to perform various trainings upon demand.

SUMMARY OF THE INVENTION

In order to achieve aforementioned objective, the present disclosure is to provide a two-in-one training device including a support structure, a resistance output module, a cable rolling device, a rear pulley, a cable, a handle assembly, and an operating module. The support structure includes a front support member, a connection frame, and a rear support member. An end of the connection frame is connected with the front support member. The rear support member is connected with other end of the connection frame. The resistance output module is disposed at an end of the support structure, and includes a resistance device, a controlling device, and a cable rolling device. The controlling device is electrically connected to the resistance device and configured to receive setting data and generate a control signal according to the setting data. The cable rolling device is connected to the resistance output module. An end of the cable is wound on the cable rolling device, and the rear pulley is disposed on an end of the support structure. The handle assembly is connected with other end of the cable for a user to hold for completing a training action. The operating module is electrically connected to the resistance output module and configured to input the setting data to the controlling device. When the connection frame is disposed horizontally relative to a ground surface, the front support member and the rear support member support the connection frame to horizontally suspend above the ground surface, and the training action is performed in a horizontal direction. When the connection frame is disposed longitudinally relative to ground surface, the front support member is placed on the ground surface to support longitudinal disposal of the connection frame on the ground surface, and the cable runs through the rear pulley, and the training action is performed in a longitudinal direction.

Preferably, the training action includes a pulling action and a recovery action.

Preferably, the rear pulley is rotatably or detachably disposed at an end of the support structure.

Preferably, the two-in-one training device further includes a front pulley disposed on the support structure.

Preferably, the two-in-one training device further includes a movable user support and a foot plate which are disposed on the support structure.

Preferably, the two-in-one training device further includes a support bottom plate connected with the front support member.

Preferably, the two-in-one training device further includes a display device configured to display the setting data inputted through the operating module for the resistance output module.

Preferably, the display device changes a display mode according to horizontal or longitudinal disposal of the support structure.

Preferably, the front support member and the rear support member may be rotated and fixed to a first angle or a second angle which are different from each other by 180 degrees.

Preferably, when the connection frame is disposed longitudinally relative to the ground surface, at least one of the front support member and the rear support member may be rotated and fixed to any angle.

BRIEF DESCRIPTION OF THE DRAWINGS

The structure, operating principle and effects of the present disclosure will be described in detail by way of various embodiments which are illustrated in the accompanying drawings.

DETAILED DESCRIPTION OF THE PREFERRED EMBODIMENTS

Figure 1:
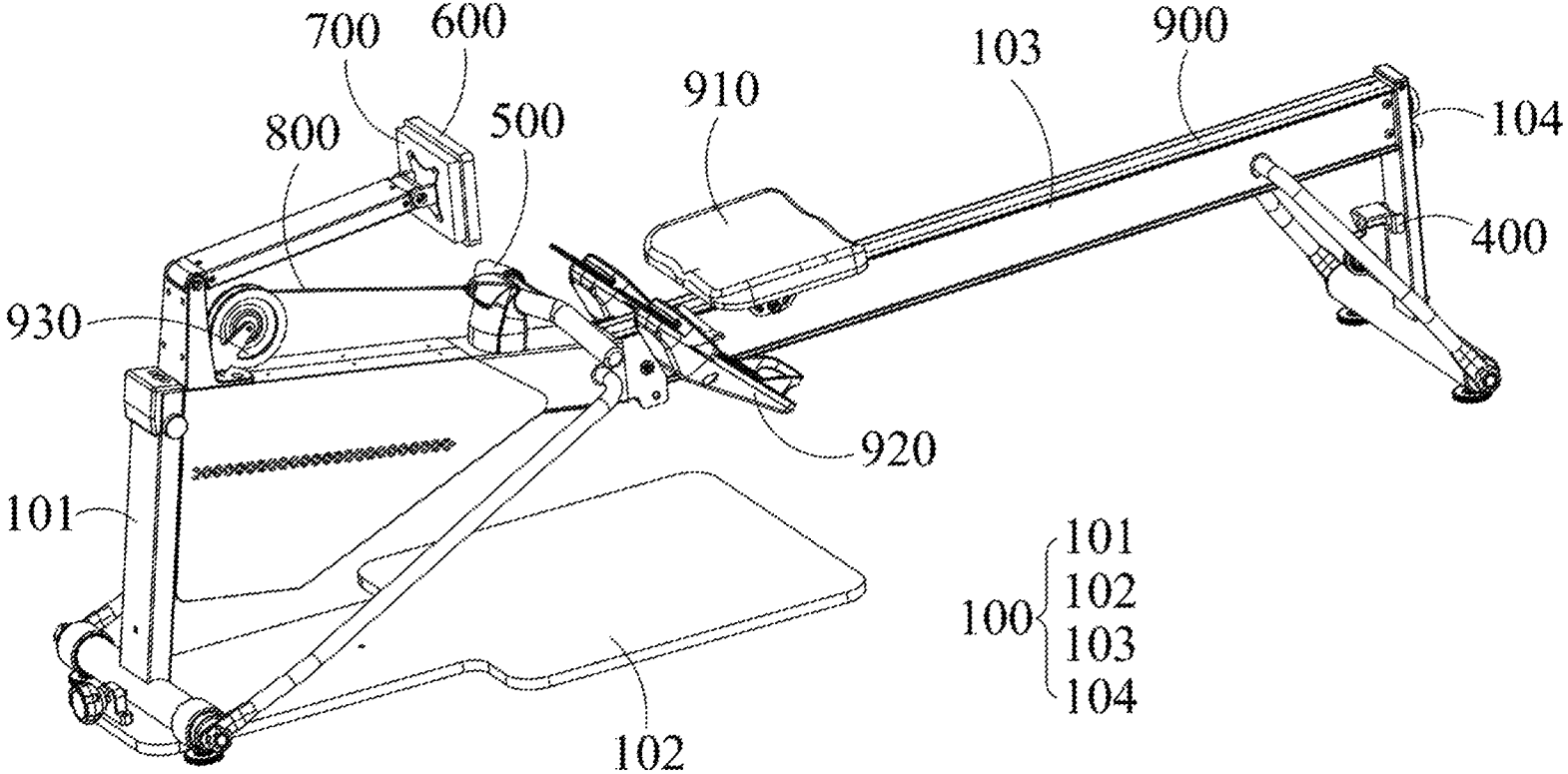
FIG. 1 is a schematic view of an embodiment of a two-in-one training device of the present disclosure, when the two-in-one training device is horizontally disposed.
Figure 2:
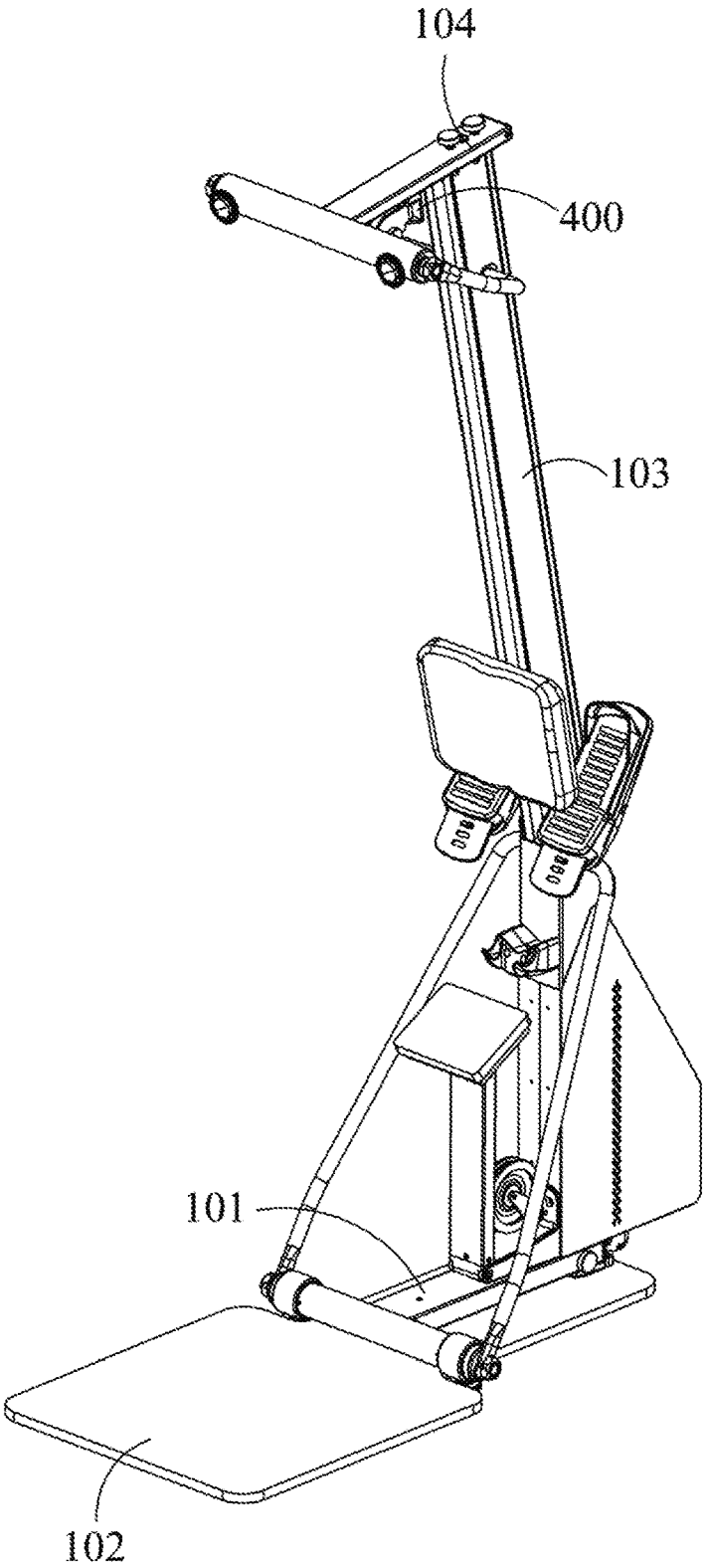
FIG. 2 is a schematic view of the embodiment of the two-in-one training device of the present disclosure, when the two-in-one training device is longitudinally disposed.
Figure 3:
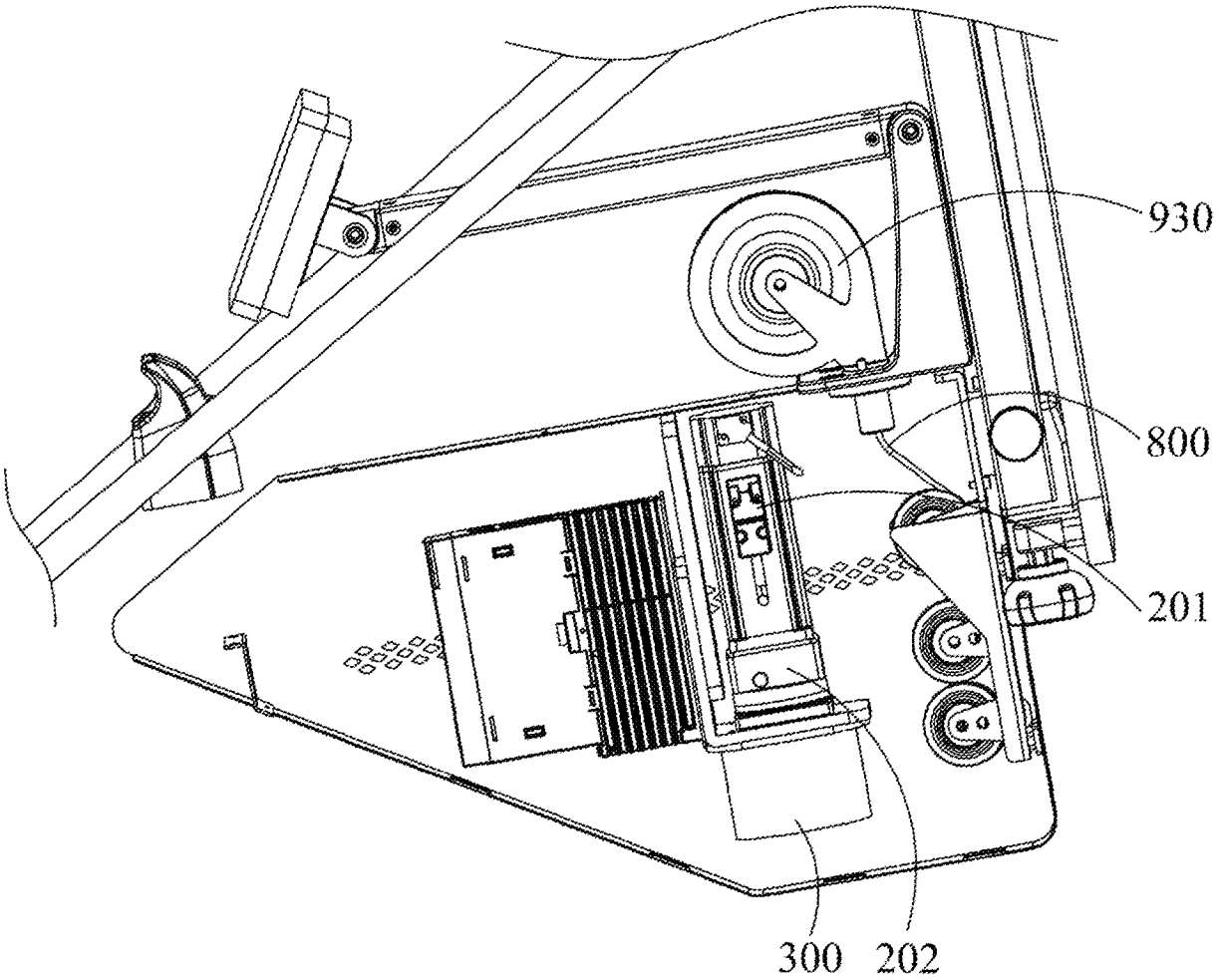
FIG. 3 is a schematic view of a part of the embodiment of the two-in-one training device of the present disclosure.
Figure 4:
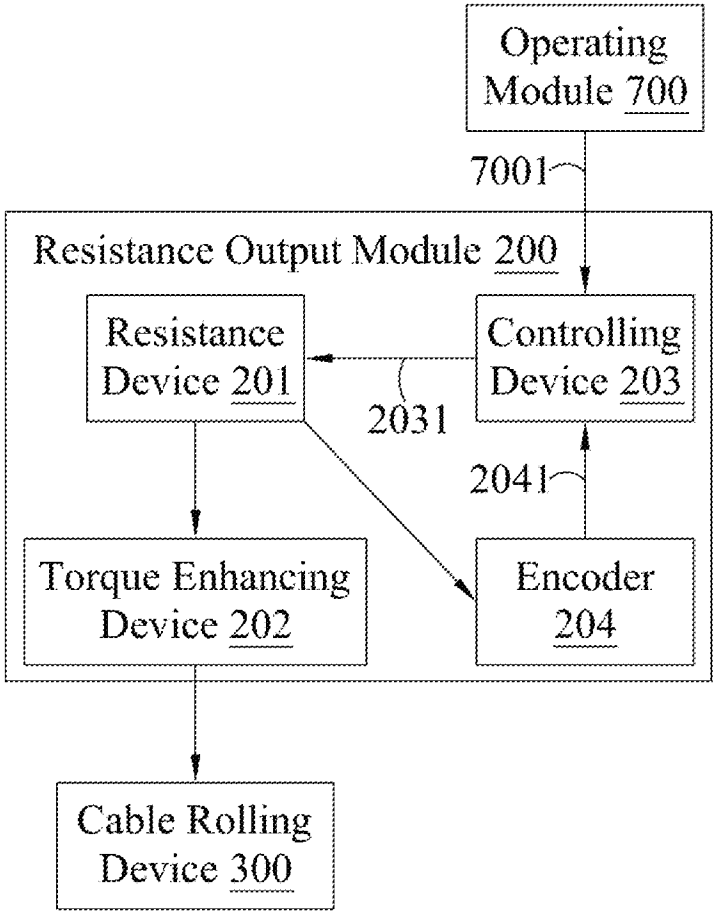
FIG. 4 is a system block diagram of the embodiment of the two-in-one training device of the present disclosure.

The following embodiments of the present invention are herein described in detail with reference to the accompanying drawings. These drawings show specific examples of the embodiments of the present invention. It is to be understood that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present invention. As used herein, the term "or" includes any and all combinations of one or more of the associated listed items.

The following refers to FIGS. 1 through 4, which respectively show horizontal disposal, longitudinal disposal, a schematic view of a part, and a system block diagram of an embodiment of a two-in-one training device of the present disclosure.

The two-in-one training device includes a support structure 100, a resistance output module 200, a cable rolling device 300, a cable 800, a front pulley 930, a rear pulley 400, and a handle assembly 500.

The support structure 100 includes a front support member 101, a connection frame 103, and a rear support member 104. An end of the connection frame 103 is coupled with the front support member 101. Preferably, the support structure 100 may further include a support bottom plate 102 to support the two-in-one training device of the present disclosure more stably. The rear support member 104 is coupled with the other end of the connection frame 103.

The resistance output module 200 may be disposed at an end of the support structure 100. The resistance output module 200 may include a resistance device 201 and a controlling device 203, and may further include a torque enhancing device 202 and an encoder 204 upon demand. Under a condition that the torque provided by the resistance device 201 is not sufficient, the torque enhancing device 202 may be connected to the resistance device 201 which is configured to output a revolving speed lower than that of the resistance device 201 and a torque higher than that of the resistance device 201. The resistance device 201 in cooperation with the torque enhancing device 202 can output more torque, so that the resistance output module 200 of the present disclosure is able to output sufficient resistance for training.

The controlling device 203 is electrically connected with the resistance device 201. Under a condition that the controlling device 203 includes the encoder 204 configured to detect an operational state of the resistance device 201 to output a detection signal 2041, the controlling device 203 may receive the detection signal 2041 from the encoder 204 and setting data 7001, and generate and transmit a control signal 2031 according to the detection signal 2041 and the setting data 7001. The operational state of the resistance device 201 may include a rotational position, a rotational velocity, a rotational angular velocity, a rotational acceleration, and so on. The encoder 204 may transmit the detection signal 2041 to the controlling device 203 to control the resistance device 201, thereby forming a feedback control scheme.

The cable rolling device 300 is connected with the resistance output module 200, and rotated in the same direction as the resistance device 201.

An end of the cable 800 is wound on the cable rolling device 300.

The front pulley 930 may be disposed at an end of the support structure 100, and the rear pulley 400 may be disposed at the other end of the support structure 100, and the rear pulley 400 is rotatably or detachably disposed on the rear support member 104.

The handle assembly 500 may be connected with the other end of the cable 800 for the user to hold for completing a training action.

The user can use the operating module 700 to input the setting data 7001 for setting the resistance output module 200, so that the resistance output module 200 is able to change different resistance according to the setting data 7001. The operating module 700 of the present disclosure is electrically connected to the resistance output module 200 and is configured to input setting data 7001 to the controlling device 203, thereby controlling the resistance device 201 to achieve the effect of changing the output resistance of the resistance output module 200.

As shown in FIG. 1, the present disclosure further includes a sliding rail structure 900, a movable user support 910, a foot plate 920, and a display device 600.

The sliding rail structure 900 is disposed on the support structure 100, and the movable user support 910 is slidably connected on the sliding rail structure 900. The foot plate 920 may be disposed on the support structure 100, and between the resistance output module 200 and the sliding rail structure 900. The front pulley 930 is disposed on the support structure 100, and the cable 800 runs through the pulley 930.

The display device 600 is configured to display the setting data 7001 for the resistance output module 200. Preferably, the operating module 700 may be integrated with the display device 600 to form a touch control display device, so that the user may directly touch the display device 600 to use the operating module 700 to input the setting data 7001 for the resistance output module 200.

The following refers to FIGS. 4 through 8, which respectively show schematic views of the first usage status, the second usage status, the third usage status and the fourth usage status of the embodiment of the two-in-one training device of the present disclosure.

As shown in FIGS. 4 through 8, the training actions include a pulling action and a recovery action which both are horizontal motions. During the pulling action, the resistance output module 200 provides a predetermined reverse resistance against the pulling action, and the resistance device 201 is counter-rotated correspondingly to the pulling action. When the user applies a force, which is smaller than the reverse resistance, on the handle assembly 500, the resistance device 201 is changed to an original rotational direction thereof, so that the predetermined reverse resistance of the resistance output module 200 serves as a restoring force to drive the cable rolling device 300 to receive the cable 800. After the encoder 204 detects the change of the rotational direction of the resistance device 201, the encoder 204 transmits the detection signal 2041 to the controlling device 203, and the controlling device 203 then transmits the control signal 2031 to control the resistance device 201 according to the detection signal 2041. Alternatively, upon practical demand, the user may increase or decrease the restoring force of the recovery action through the operating module 700.

Furthermore, when the support structure 100 is disposed horizontally relative to a ground surface, the front support member 101 and the rear support member 104 supports the connection frame to suspend horizontally above the ground surface, so that the two-in-one training device of the present disclosure may be used as a rowing exercise machine, and the training action is performed in the horizontal direction, and the cable 800 runs through the front pulley 930.

When the support structure 100 is disposed longitudinally relative to the ground surface, the front support member 101 is placed on the ground surface to support the connection frame 103 to stand longitudinally on the ground surface, the cable 800 runs through the rear pulley 400 and the front pulley 930, so that the user may operate the two-in-one training device of the present disclosure to perform the training action in the longitudinal direction. Therefore, upon demand, the two-in-one training device of the present disclosure may be respectively disposed horizontally or longitudinally to provide the user to perform the training action in the horizontal direction or longitudinal direction, so that the user may train upper back muscles, shoulder and arm muscles completely.

Figure 7:
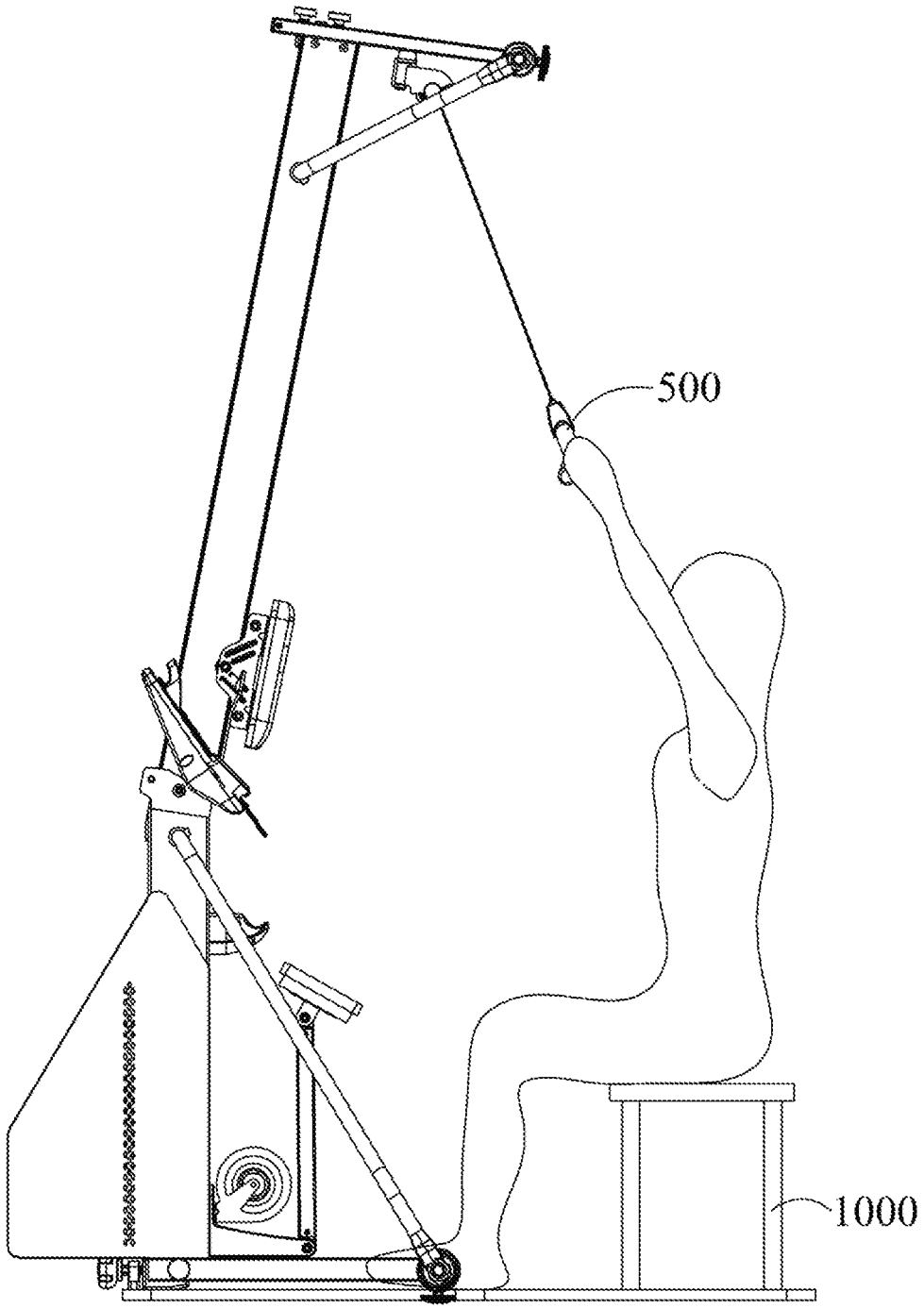
FIG. 7 is a schematic view of a third usage status of the embodiment of the two-in-one training device of the present disclosure.
Figure 8:
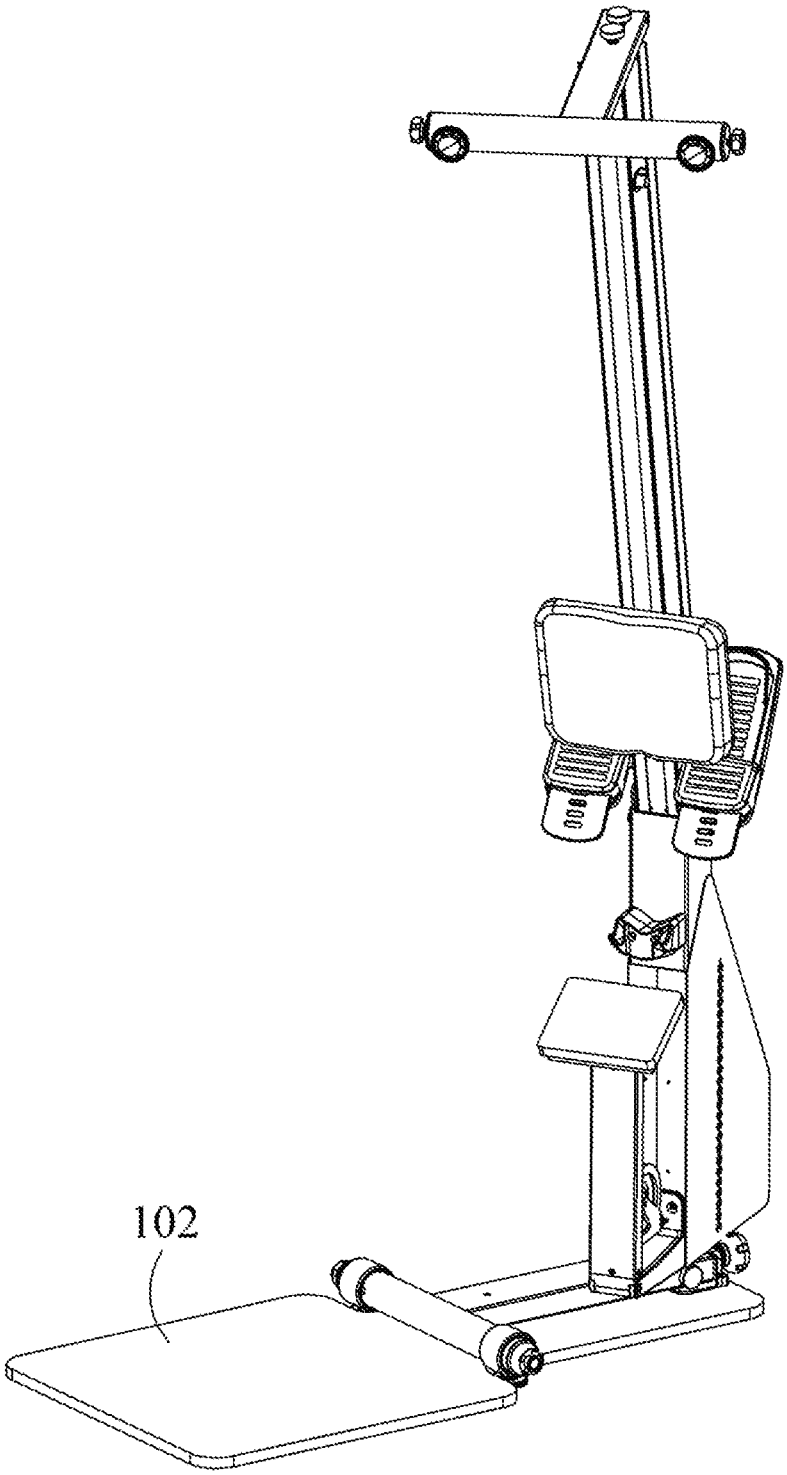
FIG. 8 is a schematic view of a fourth usage status of the embodiment of the two-in-one training device of the present disclosure.

As shown in FIG. 7, the two-in-one training device of the present disclosure may further include a foldable chair 1000 disposed on the support bottom plate 102, so that the user may perform a lat pulldown action in a sitting posture.

Figure 5:
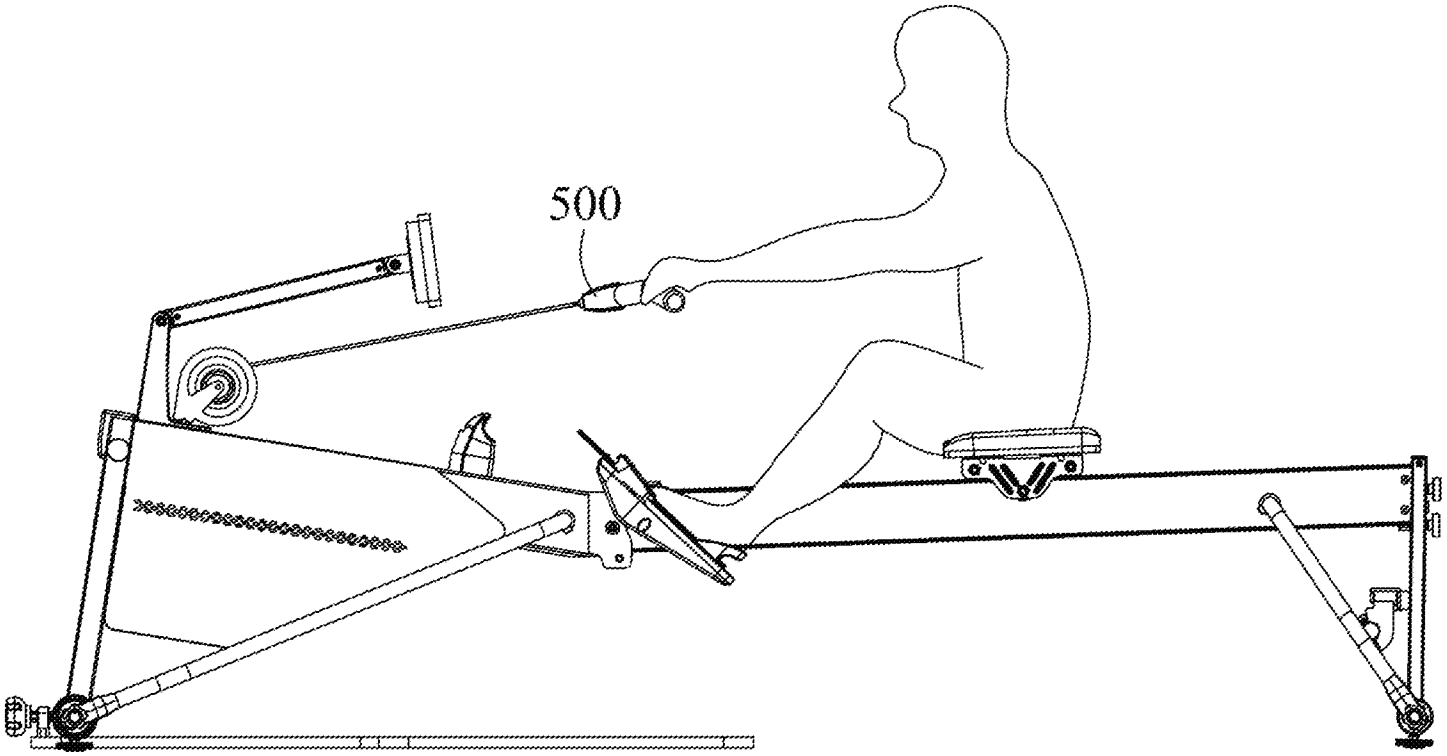
FIG. 5 is a schematic view of a first usage status of the embodiment of the two-in-one training device of the present disclosure.
Figure 6:
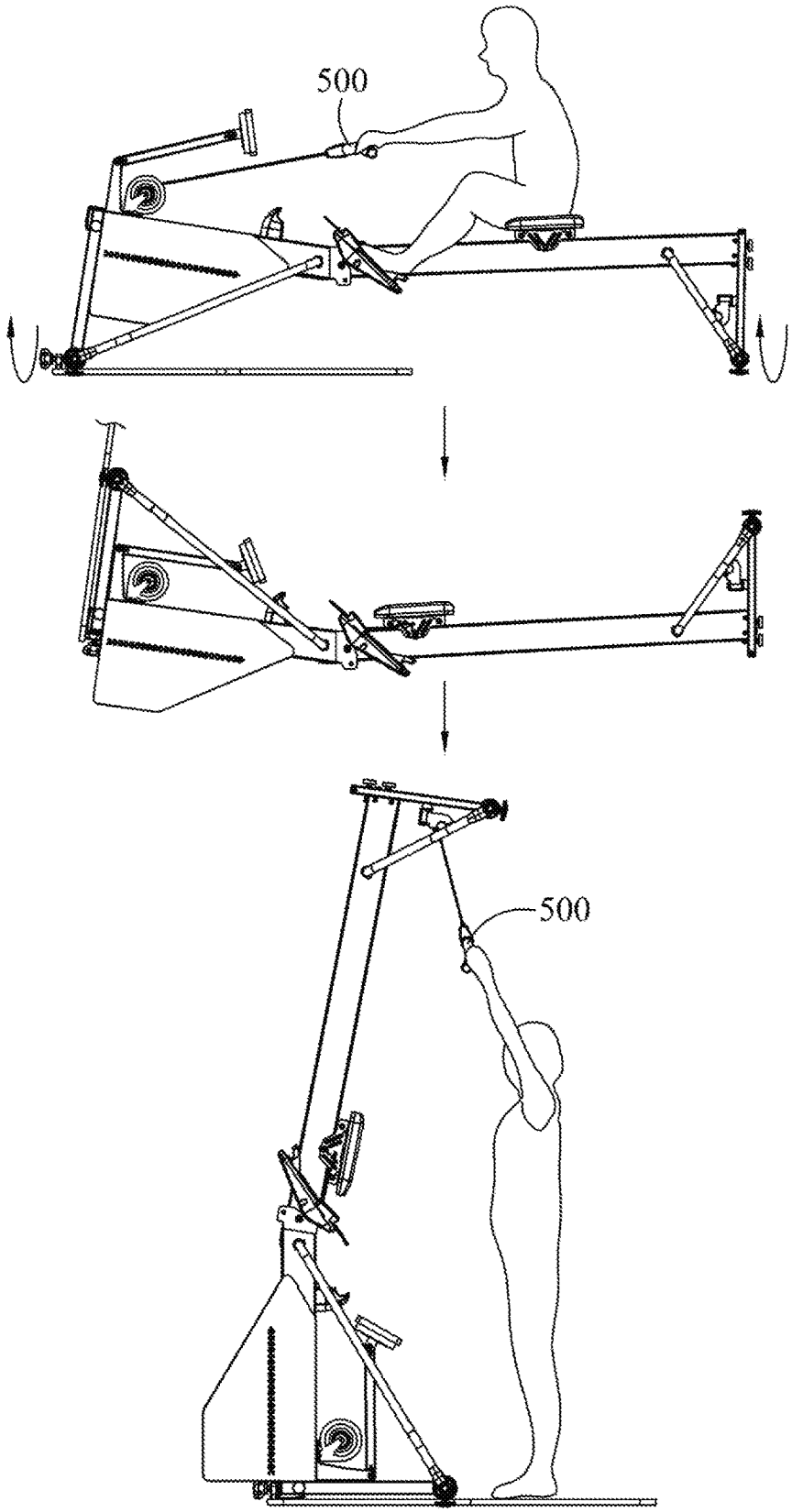
FIG. 6 is a schematic view of a second usage status of the embodiment of the two-in-one training device of the present disclosure.

Preferably, the front support member 101 and the rear support member 104 may be T-shaped support members, as shown in FIGS. 5 and 6. Preferably, the front support member 101 and the rear support member 104 can be respectively rotated and fixed to a first angle or a second angle which may be different from each other by 180 degrees, so that the two-in-one training device of the present disclosure may be more stably disposed horizontally or longitudinally.

Alternatively, at least one of the front support member 101 and the rear support member 104 may be respectively rotated and fixed to any angle, so that the user can pull down the handle assembly 500 in any direction for training.

In order to ensure stable disposal of the two-in-one training device in horizontal mode or longitudinal mode, the two-in-one training device may further include a support bottom plate 102 connected to the front support member 101, as shown in FIGS. 5 through 7, the support bottom plate 102 may be disposed under the front support member 101 when the support structure 100 is disposed horizontally or longitudinally relative to the ground surface.

Furthermore, the display device 600 may change a display mode thereof according to the horizontal or longitudinal disposal of the support structure 100, to clearly show information to the user no matter what type of disposal of the two-in-one training device of the present disclosure. Therefore, the user can operate the two-in-one training device of the present disclosure to completely train upper back muscles, shoulder and arm muscle.

The present disclosure disclosed herein has been described by means of specific embodiments. However, numerous modifications, variations and enhancements can be made thereto by those skilled in the art without departing from the spirit and scope of the invention set forth in the claims.

What is claimed is:

1. A two-in-one training device, comprising:

a support structure comprising:

a front support member;

a connection frame, comprising a first end connected with the front support member; and a rear support member, connected with a second end of the connection frame;

a resistance output module disposed at a first end of the support structure, and comprising:

a resistance device;

a controlling device electrically connected to the resistance device and configured to receive setting data and generate a control signal according to the setting data; and a cable rolling device connected with the resistance output module;

a cable, comprising an end wound on the cable rolling device;

a rear pulley disposed on a second end of the support structure;

a handle assembly connected with another end of the cable for a user to hold for completing a training action; and an operating module electrically connected to the resistance output module and configured to input the setting data to the controlling device;

wherein the training device is configurable in a first position where the connection frame is disposed horizontally relative to a ground surface such that the front support member and the rear support member contact the ground surface to horizontally suspend the connection frame above the ground surface, and the training action is performable in a horizontal direction;

wherein the training device is configurable from the first position to a second position where the connection frame is disposed longitudinally relative to the ground surface such that the front support member is placed in contact with the ground surface and the rear support member is positioned away from the ground surface to support longitudinal disposal of the connection frame, and the cable is configured to attach to the rear pulley such that the training action is performable in a longitudinal direction.

2. The two-in-one training device according to claim 1, wherein the training action includes a pulling action and a recovery action.

3. The two-in-one training device according to claim 1, wherein the rear pulley is rotatably or detachably disposed at the second end of the support structure.

4. The two-in-one training device according to claim 1, further comprising a front pulley disposed on the support structure.

5. The two-in-one training device according to claim 1, further comprising a movable user support and a foot plate which are disposed on the support structure.

6. The two-in-one training device according to claim 1, further comprising a support bottom plate connected with the front support member.

7. The two-in-one training device according to claim 1, further comprising a display device configured to display the setting data inputted through the operating module for the resistance output module.

8. The two-in-one training device according to claim 7, wherein the display device changes a display mode according to horizontal or longitudinal disposal of the support structure.

9. The two-in-one training device according to claim 1, wherein the front support member and the rear support member are rotated and fixed to a first angle or a second angle which are different from each other by 180 degrees.

10. The two-in-one training device according to claim 1, wherein when the connection frame is disposed longitudinally relative to a ground surface, at least one of the front support member and the rear support member is rotated and fixed to any angle.

* * * * *